United States Patent [19]

Harl

[11] Patent Number: 4,903,501

[45] Date of Patent: Feb. 27, 1990

[54] REFRIGERATOR AIR CONTROL HEATED BAFFLE

[75] Inventor: James O. Harl, Center Township, Vanderburgh County, Ind.

[73] Assignee: Whirlpool Corporation, Benton Harbor, Mich.

[21] Appl. No.: 209,589

[22] Filed: Jun. 22, 1988

[51] Int. Cl.[4] ..... F25D 17/08

[52] U.S. Cl. ..... 62/187; 62/231; 62/275; 137/341; 219/209

[58] Field of Search ..... 62/275, 272, 408, 187, 62/231; 137/341, 625.33; 219/200, 201, 209; 98/41.3

[56] References Cited

U.S. PATENT DOCUMENTS

| | | | |
|---|---|---|---|
| 3,059,091 | 10/1962 | Wenzel | 219/201 X |
| 3,636,312 | 1/1972 | Dreher et al. | 137/341 X |
| 3,658,085 | 4/1972 | Cannella | 137/341 |
| 4,257,445 | 3/1981 | Cook et al. | 137/341 |
| 4,499,917 | 2/1985 | Fujiya | 137/341 |
| 4,682,474 | 7/1987 | Janke | 62/187 |
| 4,688,393 | 8/1987 | Linstromberg et al. | 62/187 |
| 4,732,010 | 3/1988 | Linstromberg et al. | 62/187 |
| 4,759,198 | 7/1988 | Yamada | 137/341 X |

*Primary Examiner*—William E. Tapolcai
*Attorney, Agent, or Firm*—Wood, Dalton, Phillips, Mason & Rowe

[57] ABSTRACT

An air baffle for a refrigeration apparatus is provided with means for preventing freeze up of the baffle. The baffle includes a fixed plate and a movable plate each having corresponding apertures therethrough for permitting the control of air flow to a fresh food compartment. The fixed plate is provided with a heating device molded therein which is operable to maintain the fixed plate above the freezing temperature to prevent moisture from freezing thereon. Additionally, spacer means are provided for maintaining the movable plate in spaced relation with the fixed plate, and for preventing the movable plate from coming into contact with an actuator device. The spacer means add to the prevention of freeze up problems as by minimizing moisture which might bridge and freeze up between the movable plates and the fixed plate, or the movable plate and the actuator device.

10 Claims, 1 Drawing Sheet

FIG. 1
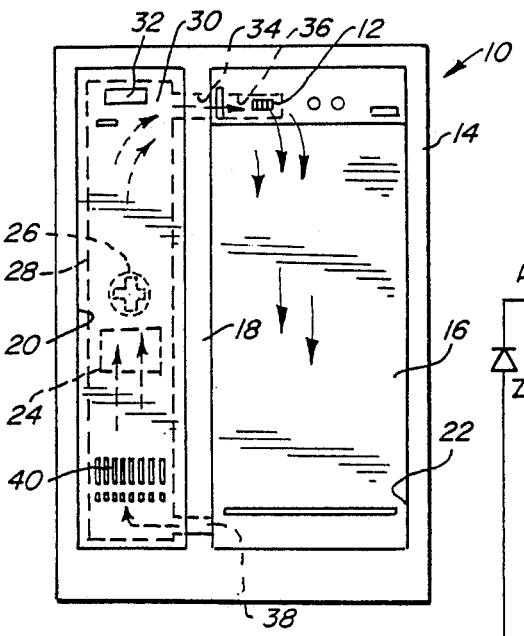
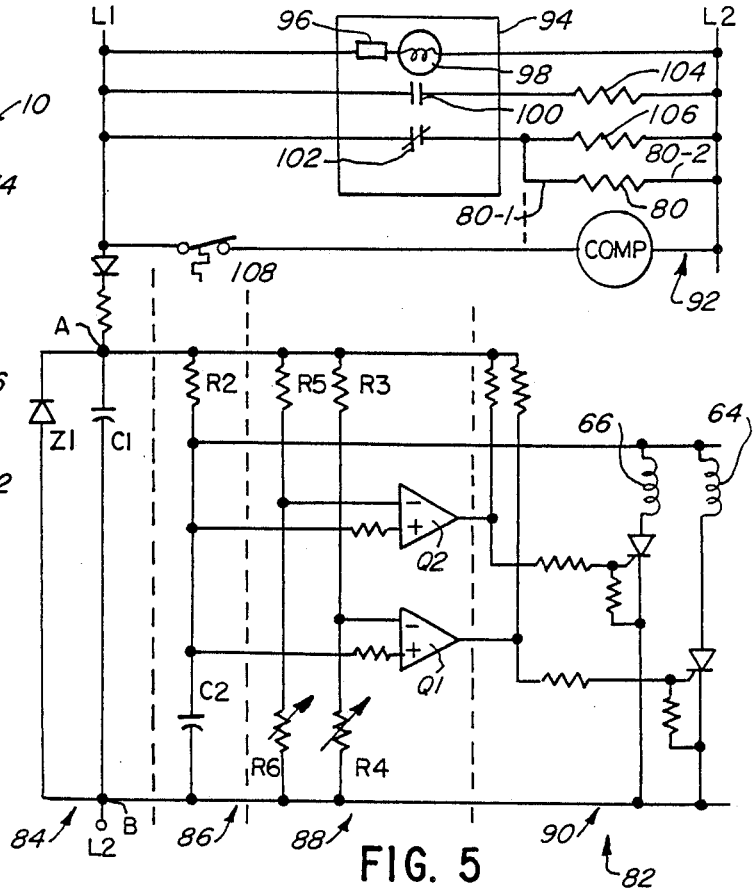
FIG. 5
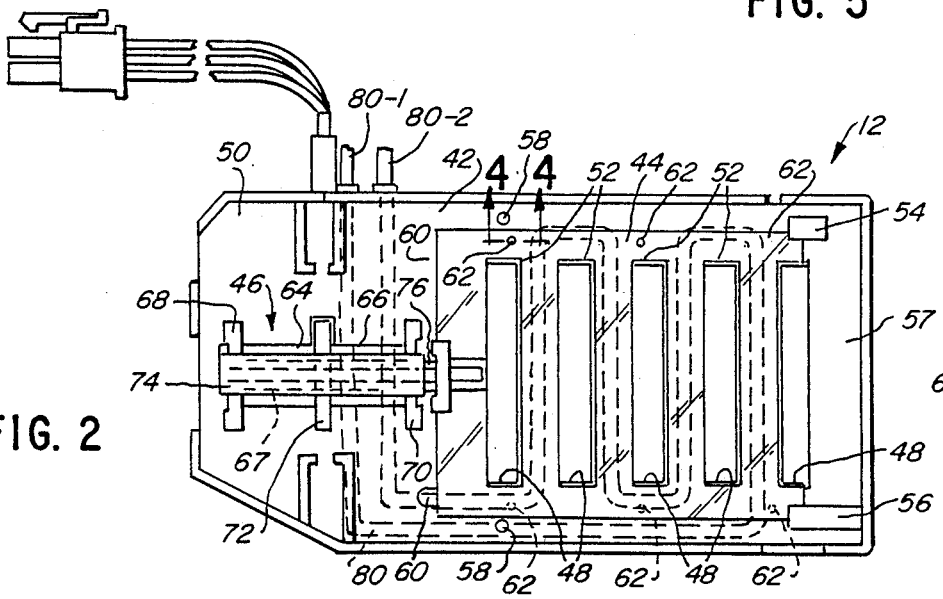
FIG. 2
FIG. 4
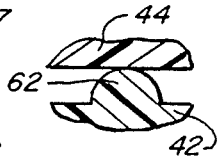
FIG. 3
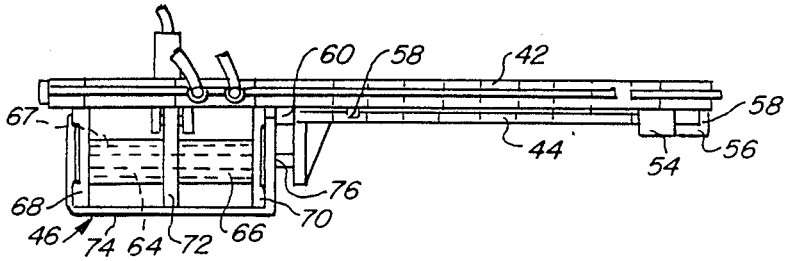

REFRIGERATOR AIR CONTROL HEATED BAFFLE

BACKGROUND OF THE INVENTION

1. Field of the Invention:

This invention relates generally to refrigerator air control baffles, and more particularly, an improved baffle which prevents freeze up thereof 2. Description of Background Art:

Conventional dual compartment refrigerators of the forced air circulation type utilize a single evaporator and an evaporator fan for generating refrigerated air for cooling a freezer compartment thereof. The freezer compartment is coupled by a plurality of air passages through a divider wall to a fresh food compartment. An air baffle has been located within the fresh food compartment air inlet passage. The baffle is operable to control the passage of refrigerated air into the fresh food compartment. Such an arrangement is shown in Janke, U.S. Pat. No. 4,682,472, assigned to the assignee of the present invention.

With such a conventional refrigerator, if the refrigeration unit is operating, then the evaporator fan forces air flow across the evaporator coils and out the top of the freezer into a scoop which directs air to the fresh food compartment, past the baffle The fan flow overcomes natural convective flow caused by air density difference. Resultantly, with the fan on, air enters at the top, circulating within the fresh food compartment, and returns out of the bottom through an air outlet passage, back to the freezer compartment.

During a conventional automatic defrost cycle, moisture can accumulate on the baffle. The amount of the moisture depends in part on the ambient humidity. Once the defrost cycle is complete, the subsequent unit cycle time is of greater length since the cabinet must overcome the heat produced by the defrost heater. Colder air from the evaporator coils can cause any moisture accumulated on the baffle to freeze. The resulting ice prevents free movement of the baffle resulting in overcooling of the fresh food compartment.

The present invention overcomes the above problem of the prior refrigerator air baffles, in a novel and simple manner.

SUMMARY OF THE INVENTION

In accordance with the present invention, a refrigeration apparatus is provided with a baffle including means for preventing a movable plate of the baffle from becoming immovable.

Broadly, there is disclosed herein a refrigeration apparatus including a compartment to be cooled by refrigerated air, means for providing refrigerated air, a passageway defining an opening to the compartment, the passageway being in communication with the providing means, and a selectively positionable air baffle disposed in the passageway. The air baffle includes a fixed plate and a movable plate which is movable relative to the fixed plate. Means are associated with the baffle for preventing moisture in the refrigerated air from preventing the movable plate from becoming immovable relative to the fixed plate.

It is possible for air moisture to accumulate on the baffle, which moisture can become frozen when subjected to refrigerated air flow. According to one aspect of the invention, a heater is provided for maintaining the baffle temperature above a preselected minimum temperature to prevent moisture from freezing thereon.

It is a particular feature of the invention that the heater is integrally molded in the baffle fixed plate and that the heater generates a minimal amount of heat in order to have minimal effect on the temperature of the refrigerated air.

According to another aspect of the invention, the movable plate is slidably mounted relative to the fixed plate, and a plurality of spacer studs are provided for maintaining the fixed movable plate in spaced relation with the fixed movable plate. Resultantly, any moisture which might freeze to form a bridge between the fixed plate and movable plate would do so only adjacent to the spacers, which are of small enough size so that only a weak bond could be formed therebetween.

According to yet another aspect of the invention, an actuator is provided for selectively moving the movable plate to place the baffle in an open or closed position. The actuator includes an armature fixed to the movable plate, and a coil structure. A spacer stud is provided for maintaining the movable plate in spaced relation with the coil structure to prevent any moisture condensing thereon from forming bridge therebetween which could freeze to render the movable plate immovable.

The refrigeration apparatus according to the invention includes a freezer compartment and a fresh food compartment. The freezer compartment houses an evaporator and an evaporator fan which draws air across the evaporator to provide refrigerated air. A divider wall separates the freezer compartment from the fresh food compartment. A first passage provides delivery of refrigerated air from the fan to the fresh food compartment at an inlet located at the top thereof. A second passage provides for returning air from the fresh food compartment to the freezer and includes an air outlet at the bottom of the fresh food compartment. Associated with the air inlet is a baffle according to the present invention, the baffle having closed and open positions.

The baffle includes a fixed plate having a plurality of apertures therethrough, through which refrigerated air can pass. A movable plate, slidably mounted to the fixed plate, includes a corresponding plurality of apertures therethrough. A solenoid coil, having an axially movable armature, is fixed to the fixed plate. The armature is fixedly mounted to the movable plate. The solenoid coil is selectively energizable to move the armature, and thus the movable plate, between an open position wherein the apertures of the fixed and movable plates are in alignment, and a closed position wherein the apertures of the plates are in disalignment to respectively allow or prevent refrigerated air from entering into the fresh food compartment.

The fixed plate includes a guide for guiding movement of the movable plate relative thereto. A plurality of first spacer studs extend outwardly from the fixed plate to maintain the movable plate in spaced relation thereto. A stop piece is provided for preventing the movable plate from directly contacting a coil mounting structure. A baffle heater which is molded in to the fixed plate is continually energized to prevent moisture which condenses on the baffle from freezing up. Resultantly, the spacers, the stops, and the heater, individually and collectively act to prevent the movable plate from becoming immovable relative to the fixed plate due to moisture freezing to form a bond therebetween.

Further features and advantages of the invention will readily be apparent from the specification and the drawings.

BRIEF DESCRIPTION OF THE DRAWINGS

FIG. 1 is a front elevational view of a refrigerator having an air baffle embodying the invention, the compartment doors being omitted to facilitate an illustration of the components therein;

FIG. 2 is an elevational view of a baffle according to the invention;

FIG. 3 is a plan view of the baffle of FIG. 2;

FIG. 4 is a sectional view taken along the lines 4—4 of FIG. 2; and

FIG. 5 is an electrical schematic of a control circuit for the baffle of FIG. 2.

DESCRIPTION OF THE INVENTION

Referring to FIG. 1, a refrigeration apparatus, such as a refrigerator/freezer 10, includes an air baffle 12 according to the present invention. The invention is shown utilized with a side-by-side refrigerator/freezer. However, other types of refrigeration apparatus may be used in conjunction with the air baffle 12 of the present invention, as will be obvious to those skilled in the art.

The refrigerator/freezer 10 includes cabinet 14 housing a conventional liner 16 therein, with suitable insulation provided between the liner 16 and the cabinet 14. The liner 16 includes a plurality of wall portions, as is well known, and may be of one piece construction or of multiple piece construction, as necessary or desired. The refrigerator/freezer 10 includes an insulating separator or divider wall 18 which may utilize the liner wall portions. The cabinet 14, liner 16 and divider wall 18 together define a below-freezing, or freezer, compartment 20 and a fresh food, or above-freezing, compartment 22. Suitable doors (not shown) are provided for selective access to the freezer and fresh food compartments 20 and 22.

The freezer and fresh food compartments 20 and 22 are cooled by circulating refrigerated air therethrough which has been refrigerated as a result of being passed in heat exchange relation with a conventional evaporator 24. An evaporator fan 26 draws air across the evaporator 24 with the cooled air passing through a duct 28 behind a rear wall 30 of the freezer compartment 20 and further through a freezer compartment air inlet 32. The duct 28 is also in communication with a scoop, or passage, 34 in the separator 18. The passage 34 is in communication with an air duct 36 in the upper rear section of the fresh food compartment 22, which duct 36 includes a fresh food compartment air inlet opening (not shown) The selectively positionable baffle 12 overlies the air inlet opening and is operated by a control described below to control the passage of refrigerated air into the fresh food compartment 22. The passage 34, the duct 36 and the opening collectively define an air inlet passageway.

Although the baffle 12 is illustrated overlying the air inlet opening, the baffle 12 could be disposed at various positions within the passage 34 or the duct 36 as is obvious to those skilled in the art.

Refrigerated air that passes through the passage 34 is discharged through air inlets of the baffle 12 to circulate within the fresh food compartment 22 and subsequently return to the freezer duct 28 through a return air outlet duct, or passage, 38 located in the separator 14 at the bottom rear of the fresh food compartment 22.

The refrigerated air in the freezer compartment 20 returns to the duct 28 at a freezer compartment air outlet 40 and mixes with the air returned from the fresh food compartment 22. The mixed air is drawn by the evaporator fan 26 across the evaporator 24 during a cooling unit on cycle to remove heat therefrom and recirculate the air in the compartments 20 and 22.

In addition to the evaporator 24 and the evaporator fan 26, the refrigeration apparatus 10 includes connected components such as a compressor, a condenser, a condenser fan and a defrost heater, not shown, as is well known.

Referring to FIGS. 2–4, the baffle 12 includes a fixed plate 42, a movable plate 44 and an actuator device 46. The actuator device 46 is fixedly mounted to the fixed plate 42 at an actuator mounting end 50 thereof.

The fixed plate 42 is of one-piece molded plastic construction and is generally rectangular shaped. The fixed plate 42 includes a plurality of longitudinally spaced, laterally extending apertures 48 therethrough. The apertures 48 are provided for enabling refrigerated air to enter the fresh food compartment 22 The actuator mounting end 50 of the fixed plate 42 includes no such apertures 48.

The movable plate 44 is also of generally rectangular construction, but is of smaller size then the fixed plate 42. The movable plate 44 includes a plurality of apertures 52 therethrough corresponding to the apertures 48 in the fixed plate 42.

The movable plate 44 is slidably mounted to the fixed plate 42 permitting straight line reciprocal motion of the movable plate 44 with respect to the fixed plate 42. Specifically, the fixed plate 42 includes first and second outwardly extending L-shaped slide members 54 and 56 at a distal end 57 remote from the actuator mounting end 50. The L-shaped member 54 and 56 are laterally spaced apart a distance slightly greater than the width of the movable plate 44 and to thereby define a track within which the movable plate 44 can slide. The second L-shaped member 56 includes a closed end portion 58, see FIG. 3 for limiting linear movement of the movable plate 44. A pair of longitudinally centrally located, laterally opposite guide studs 58 are provided for limiting lateral movement, or skewing, of the movable plate 44. The studs 58 are laterally spaced a distance greater than the width of the movable plate 44. A pair of laterally opposite stop members, or studs, 60 are located at the actuator end 50 of the fixed plate 42, adjacent the actuator device 46. The stop members 60 are laterally spaced apart a distance less than the width of the movable plate 44. The stop members 60 also limit linear movement of the movable plate 44. Resultantly, the movable plate 44 is slidably movable relative to the fixed plate 42 between an open position shown in FIG. 2 wherein the movable plate 44 abuts the stop members 60 with its apertures 52 in alignment with the fixed plate apertures 48 to permit refrigerated air to flow into the fresh food compartment 22. Likewise, the movable plate 44 can be moved to a closed position wherein the movable plate 44 abuts the stop piece 58 of the second L-shaped member 56 whereby the apertures 48 and 52 are in disalignment to prevent the refrigerated air from entering the fresh food compartment 22.

Each of the L-shaped members 56 and 58, guide studs 58 and stop members 60 are integrally molded with the fixed plate 42. Also integrally molded with fixed plate 42 is a plurality of spacer studs 62, see FIG. 4. The spacer studs 62 are located near the longitudinally extending edges of the fixed plate 42, laterally between the apertures 48 and the guide studs 58. The movable plate 44 bears on the spacer studs 62 which maintain the movable plate 44 in spaced relation with the fixed plate 42 to minimize friction therebetween to aid in sliding movement. Also, the spacer studs 62 minimize the amount of moisture which can bridge between the fixed plate 42 and the movable plate 44. Accordingly, if any such moisture freezes, such freezing will generally only take place in an area surrounding the spacer studs 62. Thus, when the movable plate 44 is moved by the actuator device 46, as discussed below, any bond formed therebetween caused by ice can be easily broken.

The actuator device 46 comprises a first, or open, solenoid coil 64 and an oppositely wound second, or closed, solenoid coil 66. The solenoid coils 64 and 66 are wound on a bobbin 67 including a central axial opening therethrough. The bobbin 67 includes end plates 68 and 70, and a central plate 72. The open solenoid coil 64 is wound about the bobbin 67 between the first end plate 68 and the central plate 72. The closed solenoid coil 66 is wound about the bobbin between the second end plate 70 and the central plate 72. The bobbin 67 is fixedly mounted to the fixed plate 42 with a U-shaped bracket 74 which surrounds the end plate 68 and 70 and is secured to the fixed plate 42 in a conventional manner.

An elongated iron core, or armature, 76 is affixed to the movable plate 44. The armature 76 extends into the elongated axial opening of the bobbin 67 and is actuably movable therein.

The baffle 12 is encased in a housing, not shown, to overlay the air inlet from the duct 36 to the fresh food compartment 22. The baffle 12 directs air flowing in the duct 36 through the apertures 48 and 52.

In operation, when the open solenoid 64 is energized, electrical current through the coil 64 creates a magnetic field in the portion of the bobbin 67 underlying the open coil 64, causing the armature 76, and thus the movable plate 44, to move in the direction towards the actuator device 46, setting the baffle 12 to the open position. Conversely, when the closed solenoid coil 66 is energized, electrical current through the coil 66 creates an oppositely directed magnetic field in the position of the bobbin 67 underlying the closed solenoid coil 66, causing the armature 76, and thus the movable plate 44, to move in the direction away from the actuator device 46, thus setting the baffle 12 to the closed position The stop members 60 in addition to limiting linear movement of the movable plate 44 also prevent the movable plate 44 from coming into direct contact with the actuator device 46, specifically the mounting bracket 74 and the second end plate 70. Resultantly, the stop member 60 prevents moisture from bridging between the movable plate 44 and the actuator device 46 which could possibly freeze to render the movable plate 44 immovable.

Integrally molded in the fixed plate 44 is a heating device 80. The heating device is connected to terminal leads 80-1 and 80-2. The heating device 80 comprises a resistance wire wound in a serpentine fashion around the apertures 48. In the illustrated embodiment, the heater resistance is 4.5 kΩ providing a 3-watt heater at 115 volts. When the heating device 80 is energized, heat is generated which maintains the temperature of the fixed plate above the freezing point so that any moisture that condenses thereon does not freeze. However, the heater is chosen to be of a small wattage, such as three watts, so that a minimal amount of heat is added to the refrigeration apparatus 10. Otherwise, the heater might warm the refrigerated air which passes through the baffle openings.

An electrical schematic of a control circuit 82 according to the present invention is illustrated in FIG. 5. The control circuit 82 includes a power supply circuit 84, a timer circuit 86, a bridge circuit 88, a solenoid driver circuit 90 and a heater circuit 92. The operation of each of the power supply circuit 66, timer circuit 68, bridge circuit 70 and driver circuit 71 is described in detail in Janke U.S. Pat. No. 4,682,474 owned by the assignee of the present invention, the specification of which is hereby incorporated by reference herein. Therefore, these control circuits are not described herein.

The heater circuit 92 includes a conventional defrost timer circuit 94 coupled between AC power leads L1 and L2. The defrost timer circuit 94 includes a timer 96, a coil 98, a normally open contact 100 and a normally closed contact 102. The timer 96 is in series with the coil 98 which is normally deenergized, and periodically becomes energized. Illustratively, the defrost timer circuit 94 operates on a ten hour cycle with the coil 98 being denergized for nine and one half hours, and energized for one half hour. The normally open contact 100 is connected between terminals L1 and L2 to a defrost heater 104. The normally closed contact 102 is connected in series between the terminals L1 and L2 to a conventional stile heater 106 and the parallel connected baffle heater 80. In operation, the stile heater 106 and the baffle heater 80 are normally energized, and the defrost heater is deenergized. According to the time cycle, when it is necessary to initiate a defrost cycle, the timer circuit 96 energizes the coil 98 causing the normally open contact 100 to assume a closed state thereby energizing the defrost heater 104, and the normally closed contact 102 assumes an open state thereby deenergizing the stile heater 106 and the baffle heater 80.

With the above-described circuit, the baffle heater 80 is on for nine and one-half hours out of every ten hour cycle. However, it may be desirable to energize the baffle heater 80 only when the compressor is on to minimize any heat added to the refrigeration apparatus 10 during the unit off cycle. According to an alternative embodiment, the compressor COMP is connected between the terminals L1 and L2 to a freezer thermostat 108. The baffle heater 80 is connected in parallel across the compressor COMP, as indicated by the dashed line in the heater circuit 92, instead of being in parallel with tho stile heater 106. Resultantly, the baffle heater 80 is energized when the compressor is on, and is otherwise off.

Thus, the invention broadly comprehends a refrigeration apparatus which minimizes freeze up problems for an air flow baffle.

The foregoing disclosure of the preferred embodiments is illustrative of the broad inventive concepts comprehended by the invention.

What is claimed:

1. In a refrigeration apparatus having a compartment to be cooled by refrigerated air, means for providing refrigerated air, a passageway having an opening to said compartment, said passageway being in communication with said providing means, and a selectively positionable air baffle disposed in said passageway, the air baffle including a fixed plate and a movable plate which is movable relative to said fixed plate, wherein the refrigerated air may cause moisture which accumulates on the baffle to freeze to an ice state, the improvement comprising, means associated with said baffle for preventing moisture in said refrigerated air from preventing said movable plate from become immovable relative to said fixed plate, wherein said preventing means comprises spacer means for maintaining the movable plate in spaced relation with said fixed plate to minimize the amount of ice which can develop between said fixed plate and said movable plate.

2. In a refrigeration apparatus having a compartment to be cooled by refrigerated air, means for providing refrigerated air, a passageway having an opening to said compartment, said passageway being in communication with said providing means, and a selectively positionable air baffle disposed in said passageway, the air baffle including a fixed plate and a movable plate which is movable relative to said fixed plate, and actuator means for selectively moving said movable plate and wherein said refrigerated air may cause moisture which accumulates on said baffle to freeze said movable plate into contact with said actuator, the improvement comprising, means associated with said baffle for preventing moisture in said refrigerated air from preventing said movable plate from becoming immovable relative to said fixed plate, wherein said preventing means comprises spacer means for maintaining said movable plate in spaced relation with said actuator means to prevent moisture from building up therebetween.

3. In a refrigeration apparatus having wall portions defining a compartment to be cooled, means for providing refrigerated air flow, and an air flow passage through said wall portions in communication with said providing means, an air baffle disposed in said air flow passage comprising:

a first plate including an aperture therethrough defining an opening through which refrigerated air may pass;

a second plate movable relative to said first plate and including an aperture therethrough defining an opening through which refrigerated air may pass;

actuator means for moving said second plate relative to said first plate to position said openings in a preselected alignment to control the movement of refrigerated air through said passage; and heater means for maintaining said baffle above a preselected minimum temperature, wherein said heater means comprises an electrical resistance wire coupled to an electrical circuit which is operable to develop a current through said wire to generate heat to maintain the baffle above a preselected temperature so that any moisture that accumulates thereon does not freeze and wherein said electrical circuit includes timer means to selectively energize and deenergize said heater in a timed cycle.

4. In a refrigeration apparatus having wall portions defining a compartment to be cooled, means for providing refrigerated air flow, and an air flow passage through said wall portions in communication with said providing means, an air baffle disposed in said air flow passage comprising:

a first plate including an aperture therethrough defining an opening through which refrigerated air may pass;

a second plate movable relative to said first plate and including an aperture therethrough defining an opening through which refrigerated air may pass;

actuator means for moving said second plate relative to said first plate to position said openings in a preselected alignment to control the movement of refrigerated air through said passage; and heater means for maintaining said baffle above a preselected minimum temperature, wherein said heater means comprises an electrical resistance wire coupled to an electrical circuit which is operable to develop a current through said wire to generate heat to maintain the baffle above a preselected temperature so that any moisture that accumulates thereon does not freeze and wherein said heater is electrically connected to said providing means and said heater is selectively energized responsive thereto.

5. In a refrigeration apparatus having wall portions defining a compartment to be cooled, means for providing refrigerated air flow, and an air flow passage through said wall portions in communication with said providing means, an air baffle disposed in said air flow passage comprising:

a first plate including an aperture therethrough defining an opening through which refrigerated air may pass;

a second plate movable relative to said first plate and including an aperture therethrough defining an opening through which refrigerated air may pass;

actuator means for moving said second plate relative to said first plate to position said openings in a preselected alignment to control the movement of refrigerated air through said passage;

heater means for maintaining said baffle above a preselected minimum temperature; and spacer means integral with said first plate for maintaining said second plate in spaced relation therewith.

6. In a refrigeration apparatus having wall portions defining a compartment to be cooled, means for providing refrigerated air flow, and an air flow passage through said wall portions in communication with said providing means, an air baffle overlying said air flow passage comprising:

a fixed plate fixedly mounted relative to said passage and including an aperture therethrough, defining an opening through which refrigerated air may pass, wherein said fixed plate is of generally rectangular construction and includes a plurality of longitudinally spaced laterally extending openings therethrough;

a movable plate movably mounted relative to said fixed plate and including an aperture therethrough, defining an opening through which refrigerated air may pass;

actuator means secured to said fixed plate and said movable plate for selectively moving said movable plate relative to said fixed plate between an open position wherein their respective openings are in alignment to permit refrigerated air to flow through said passage, and a closed position wherein the respective openings are in disalignment to prevent refrigerated air flow through said passage; and heater means for maintaining said baffle above a preselected minimum temperature, wherein said heater means comprises an electrically conductive resistance wire which develops heat responsive to an electrical current flowing therethrough, and wherein said heater wire extends between adjacent ones of said apertures.

7. In a refrigeration apparatus having wall portions defining a compartment to be cooled, means for providing refrigerated air flow, and an air flow passage through said wall portions in communication with said providing means, an air baffle overlying said air flow passage comprising:

a fixed plate fixedly mounted relative to said passage and including an aperture therethrough, defining an opening through which refrigerated air may pass, wherein said fixed plate includes a plurality of spacer studs extending outwardly therefrom;

a movable plate movably mounted relative to said fixed plate and including an aperture therethrough, defining an opening through which refrigerated air may pass, said movable plate bearing on said spacer studs to maintain said movable plate in spaced relation with said fixed plate to minimize contact therebetween;

actuator means secured to said fixed plate and said movable plate for selectively moving said movable plate relative to said fixed plate between an open position wherein their respective openings are in alignment to permit refrigerated air to flow through said passage, and a closed position wherein the respective openings are in disalignment to prevent refrigerated air flow through said passage; and heater means for maintaining said baffle above a preselected minimum temperature.

8. In a refrigeration apparatus having wall portions defining a compartment to be cooled, means for providing refrigerated air flow, and an air flow passage through said wall portions in communication with said providing means, an air baffle overlying said air flow passage comprising:

a fixed plate fixedly mounted relative to said passage and including an aperture therethrough, defining an opening through which refrigerated air may pass;

a movable plate movably mounted relative to said fixed plate and including an aperture therethrough, defining an opening through which refrigerated air may pass;

actuator means secured to said fixed plate and said movable plate for selectively moving said movable plate relative to said fixed plate between an open position wherein their respective openings are in alignment to permit refrigerated air to flow through said passage, and a closed position wherein the respective openings are in disalignment to prevent refrigerated air flow through said passage, wherein said actuator means comprises a solenoid coil fixedly secured to said fixed plate and an actuator axially movable relative to said solenoid and fixedly secured to said movable plate to selectively move said movable plate relative to said fixed plate, and wherein said fixed plate includes a stop member extending outwardly therefrom which is operable to limit movement of said movable plate in a direction toward said actuator means; and heater means for maintaining said baffle above a preselected minimum temperature.

9. In a refrigeration apparatus having wall portions defining a compartment to be cooled, means for providing refrigerated air flow, and an air flow passage through said wall portions in communication with said providing means, an air baffle overlying said air flow passage comprising:

a fixed plate fixedly mounted relative to said passage and including an aperture therethrough, defining an opening through which refrigerated air may pass;

a movable plate movably mounted relative to said fixed plate and including an aperture therethrough, defining an opening through which refrigerated air may pass;

actuator means secured to said fixed plate and said movable plate for selectively moving said movable plate relative to said fixed plate between an open position wherein their respective openings are in alignment to permit refrigerated air to flow through said passage, and a closed position wherein the respective openings are in disalignment to prevent refrigerated air flow through said passage; and heater means for maintaining said baffle above a preselected minimum temperature, wherein said heater means comprises an electrically conductive resistance wire which develops heat responsive to an electrical current flowing therethrough and timer means to selectively energize and deenergize said wire in a timed cycle.

10. In a refrigeration apparatus having wall portions defining a compartment to be cooled, means for providing refrigerated air flow, and an air flow passage through said wall portions in communication with said providing means, an air baffle overlying said air flow passage comprising:

a fixed plate fixedly mounted relative to said passage and including an aperture therethrough, defining an opening through which refrigerated air may pass;

a movable plate movably mounted relative to said fixed plate and including an aperture therethrough, defining an opening through which refrigerated air may pass;

actuator means secured to said fixed plate and said movable plate for selectively moving said movable plate relative to said fixed plate between an open position wherein their respective openings are in alignment to permit refrigerated air to flow through said passage, and a closed position wherein the respective openings are in disalignment to prevent refrigerated air flow through said passage; and heater means for maintaining said baffle above a preselected minimum temperature, wherein said heater means comprises an electrically conductive resistance wire which develops heat responsive to an electrical current flowing therethrough, wherein said heater means is electrically connected to said providing means and said heater means is selectively energized responsive thereto.

* * * * *